US006612213B1

(12) United States Patent
Bredenberg et al.

(10) Patent No.: US 6,612,213 B1
(45) Date of Patent: Sep. 2, 2003

(54) DOUBLE-CUT LOBED BELT DIVERTER

(75) Inventors: Paul Emmett Bredenberg, Portsmouth, NH (US); Matt Thomas Sharkady, Portsmouth, NH (US); Richard Daniel Curley, Dover, NH (US); Kevin Lauren Cote, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/435,667

(22) Filed: Nov. 8, 1999

(51) Int. Cl.[7] ..... B65H 29/58; B65H 39/10

(52) U.S. Cl. ..... 83/102; 83/94; 83/112; 83/155.1; 83/325; 83/345; 83/408; 83/424; 83/664; 83/675; 83/678; 83/934; 83/425.3; 271/300; 271/70

(58) Field of Search ..... 83/27, 89, 94, 83/102, 112, 113, 115, 150, 154, 155, 155.1, 158, 322, 323, 325, 326, 343, 345, 346, 404, 407, 408, 409.1, 424, 734, 495, 664, 673, 678, 934, 300, 303, 660, 425.3, 434; 271/279, 302, 300, 303, 272, 275, 7, 34, 198, 69, 70, 83, 184; 270/42, 52.17, 21.1, 52.09, 52.01, 47, 58.07; 198/440; 493/429, 432, 23, 357, 359

(56) References Cited

U.S. PATENT DOCUMENTS

| | | | | | |
|---|---|---|---|---|---|
| 1,532,538 | A | * | 4/1925 | Langston | 493/362 |
| 2,836,018 | A | * | 5/1958 | Key | 29/417 |
| 3,479,024 | A | * | 11/1969 | Miller et al. | 198/449 |
| 3,762,254 | A | * | 10/1973 | Tsymbal et al. | 83/107 |
| 4,432,746 | A | * | 2/1984 | DeHaan | 198/834 |
| 4,948,112 | A | * | 8/1990 | Sato et al. | 270/47 |
| 4,983,155 | A | * | 1/1991 | Stobb | 493/361 |
| 5,103,703 | A | * | 4/1992 | Littleton | 83/404 X |
| 5,146,820 | A | * | 9/1992 | Nemeth et al. | 241/236 |
| 5,197,364 | A | * | 3/1993 | Heutschi | 83/934 X |
| 5,230,268 | A | * | 7/1993 | Richter | 83/155 |
| 5,607,146 | A | | 3/1997 | Novick et al. | 270/42 |
| 5,615,878 | A | | 4/1997 | Belanger et al. | 271/302 |
| 5,702,100 | A | | 12/1997 | Novick et al. | 271/302 |
| 5,794,929 | A | | 8/1998 | Curley et al. | 271/270 |
| 5,927,712 | A | * | 7/1999 | Curley et al. | 271/277 |
| 6,019,714 | A | | 2/2000 | Stab | 493/429 |

FOREIGN PATENT DOCUMENTS

| | | |
|---|---|---|
| EP | 0315932 | 5/1989 |
| WO | 9724284 | 7/1997 |

* cited by examiner

*Primary Examiner*—Boyer D. Ashley
(74) *Attorney, Agent, or Firm*—Davidson, Davidson & Kappel, LLC

(57) ABSTRACT

A method and device for diverting signatures is disclosed. A first cutting device partially cuts a web, while a second cutting device downstream of the first cutting device fully cuts the web so as to form a plurality of signatures. At least one first belt and at least one second belt hold the plurality of signatures, with the first belt having at least one first raised outer section and passing through at least part of the second cutting device, and with the second belt having at least one second raised outer section. The first and second raised outer sections interact to offset the plurality of signatures so as to define an alternating first stream and second stream of the plurality of signatures.

12 Claims, 5 Drawing Sheets

DOUBLE-CUT LOBED BELT DIVERTER

BACKGROUND OF THE INVENTION

1. Field of the Invention

The present invention relates generally to web printing presses and more particularly to a cutting and diverter unit for a web printing press as well as to a method for cutting a web and diverting the resultant signatures into two streams.

2. Background Information

Web printing presses print a continuous web of material, such as paper. The continuous web then is cut in a cutting unit so as to form signatures which can then be folded in a folder or arranged in different manners. In order to arrange signatures in a desired fashion or to permit desired folds, the signatures often may be diverted into two streams, for example, and also may be decelerated.

U.S. Pat. No. 5,607,146 discloses a mechanism for diverting of products in a folding apparatus. A pair of cutting cylinders cuts the web, so that signatures are accepted by a pair of transport belts. Each transport belt has a raised surface which interacts with a non-raised surface of the other belt. The raised surfaces of the belts thus cause each signature to be diverted off a center line in alternating fashion, so that one signature is offset slightly to the left side and the next slightly to the right side. The signatures then are directed to past a guide member depending on whether the signatures are offset to the left or to the right to pockets of side-by-side fan wheels, so that the right fan wheel accepts a signature diverted to the right and the left fan wheel accepts the next signature, which is diverted to the left. The terms "right" and "left" are used here for descriptive purposes only. The signatures are thus split into two streams by the fan pockets.

U.S. Pat. No. 5,615,878 discloses a cutting device which fully cuts a web into signatures, which then are accepted by two transport belts having interlacing raised sections. The raised surfaces of the belts thus cause each signature to be diverted off a center line in alternating fashion, so that one signature is offset slightly to one side into a first fan and the next slightly to the other side into a second fan. The first and second fans are located side-by-side and their fan blades overlap.

U.S. Pat. No. 5,702,100 also discloses a cutting device for cutting a web into signatures that are accepted by transport belts. Two diverting elements divert each signature into one of two side-by-side fans.

The devices of the above-cited patents have the disadvantage however that the signatures are fully cut far away from the belts, which can lead to a poor cutting device-to-tape transfer. Also the top ends of the signatures are poorly supported. These disadvantages can lead to signatures being damaged or not properly diverted. Moreover, the signatures are diverted using side-by-side devices, which can require substantial and often valuable floor space.

BRIEF SUMMARY OF THE INVENTION

An object of the present invention is to provide a reliable device and method for diverting signatures. An alternate or additional object of the present invention is to reduce floor space requirements for a diverter.

The present invention provides a method for cutting a web and diverting signatures which includes the steps of partially cutting the web so as to form a partially cut web section; cutting the partially cut web section with a cutting device so as to form signatures; passing a first belt through at least a part of the cutting device; and holding the signatures between the first belt and a second belt so that the signatures are offset in an alternating fashion to define a first stream and a second stream of the signatures.

The present method advantageously provides a double-cut configuration which can allow for holding of the signatures closer to the last cut so that when the web is cut into signatures, it may be held firmly in place by the pair of belts. Tension and proper placement may be maintained at all times even as the web is cut. The resultant diverting of the signatures thus also may be performed effectively.

Preferably, the method may include matching a lead edge of the signatures with a rear edge of a raised section of one of the belts at the cutting device. This procedure allows for close placement of the belts near the cutting operation, which with the single cut devices of the prior art was difficult or impossible to achieve.

Advantageously, after the signatures are offset to define first and second streams, the first stream and second stream of signatures may be gripped respectively by a first delivery device and a second delivery device, which may be, for example, deceleration devices.

In accordance with a further embodiment of the present invention, the delivery devices may be located one above the other to reduce floor space. Preferably, when the delivery devices are located one above the other the first stream of signatures are offset in a first direction, gripped by the first delivery device, released by the second belt moving away and then supported by a first signature support. The second stream of signatures may be offset in a direction opposite the first direction so as to pass by the first signature support. The first belt and a back side of first signature support then may be used to further support the second stream of signatures. The second stream of signatures then may be gripped by a third belt and the first belt and transported to the second delivery device.

The present invention also provides a diverter which includes a first cutting device for partially cutting a web; a second cutting device downstream of the first cutting device for fully cutting the web so as to form a plurality of signatures; and at least one first belt and at least one second belt for holding the plurality of signatures, the first belt having at least one first raised outer section and passing through at least part of the second cutting device, the second belt having at least one second raised outer section, the first and second raised outer sections interacting to offset the plurality of signatures so as to define an alternating first stream and second stream of the plurality of signatures.

One advantage of the present device is that tension and proper signature placement may be maintained during cutting by having the two cutting devices and the first belt passing through at least part of the second cutting device, and that the resultant offsetting provides effective diverting of the signatures. Advantageously, both of the first and second belts may pass entirely through the second cutting device to aid in holding the signatures just after they are cut.

Advantageously, more belts than just the first belt and the second belt are provided so as to define a plurality of paired belts spaced apart from one another. The second cutting device may include a plurality of cutting disks spaced apart from one another so as to define non-cut spaces. The paired belts advantageously pass through the non-cut spaces in the second cutting device.

Advantageously, a first delivery device receives the first stream of signatures; and a second delivery device receives the second stream of signatures.

The first delivery device preferably has a first signature support for supporting the signature after the signature is not longer held by the first and second belt. The first signature support may have a support side with a curved section and a straight rear side, which advantageously may support signatures of the second stream before those signatures are held between the first belt and a third belt, or are delivered directly to the second delivery device. The third belt may begin within cut-out regions at the rear of the signature support of the first delivery device.

The first and second delivery devices advantageously are gripper deceleration devices which can-slow down the rate of delivery of the signatures.

The present device is particularly advantageous for use with high-speed web printing presses, e.g. presses operating at over 2000 feet per minute, since the signatures are held firmly at all times.

The present invention also provides a floor-space-saving diverter comprising a cutting device for cutting a web so as to form a plurality of signatures, a first belt and a second belt with raised outer sections interacting to offset the plurality of signatures so as to define an alternating first stream and second stream of the plurality of signatures, a first delivery device for accepting the first stream; and a second delivery device located below the second delivery device for accepting the second stream.

BRIEF DESCRIPTION OF THE DRAWINGS

Two embodiments of the present invention are described below by reference to the following drawings, in which.

DETAILED DESCRIPTION

Figure 1:
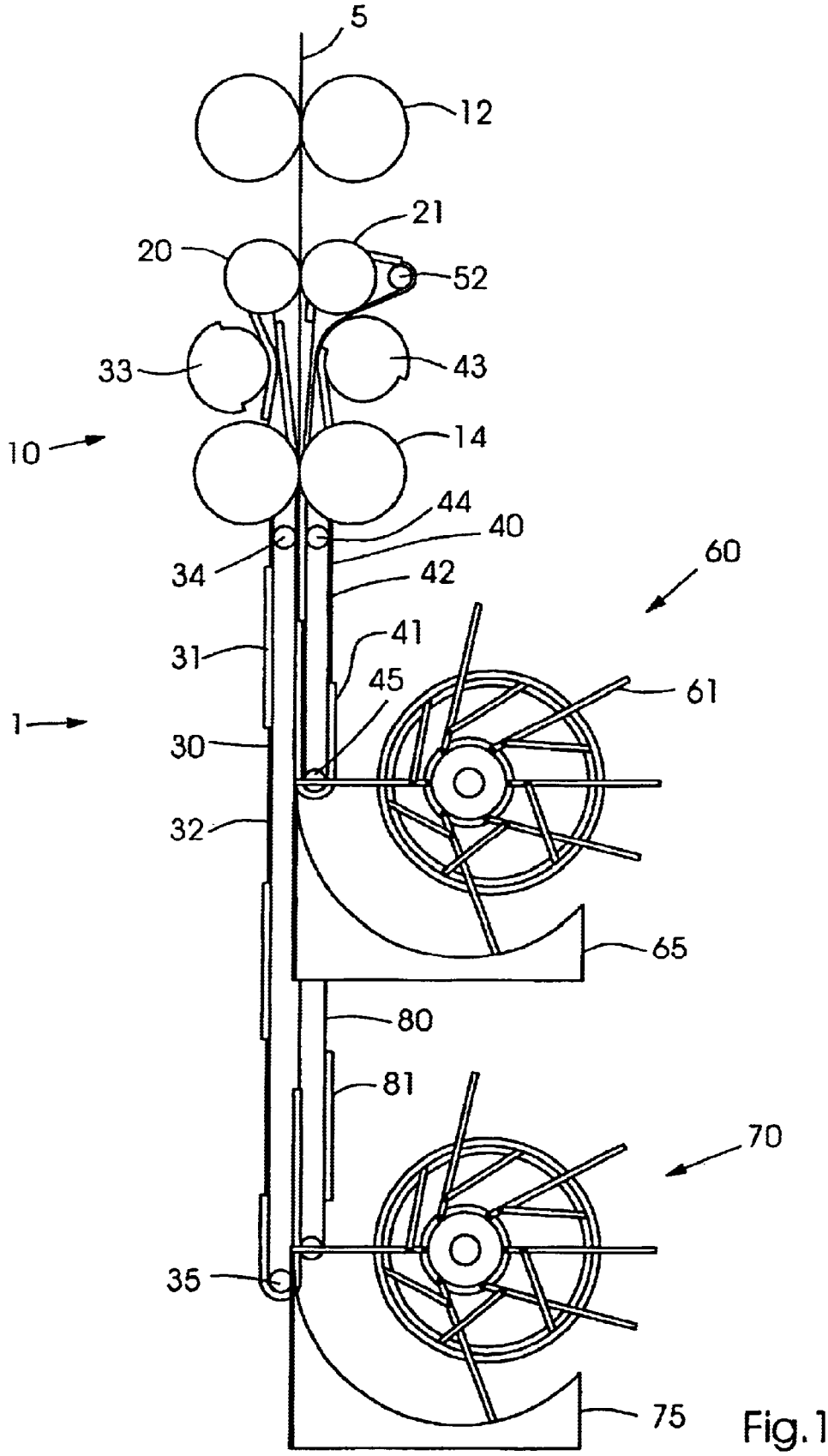
FIG. 1 shows a side view of a first embodiment of a cutting and diverter unit of an offset web printing press according to the present invention.

FIG. 1 shows in side view a first embodiment of the present invention. Schematically depicted is a diverter 1 having a cutting unit 10, which is shown in perspective front view in FIG. 2.

Figure 2:
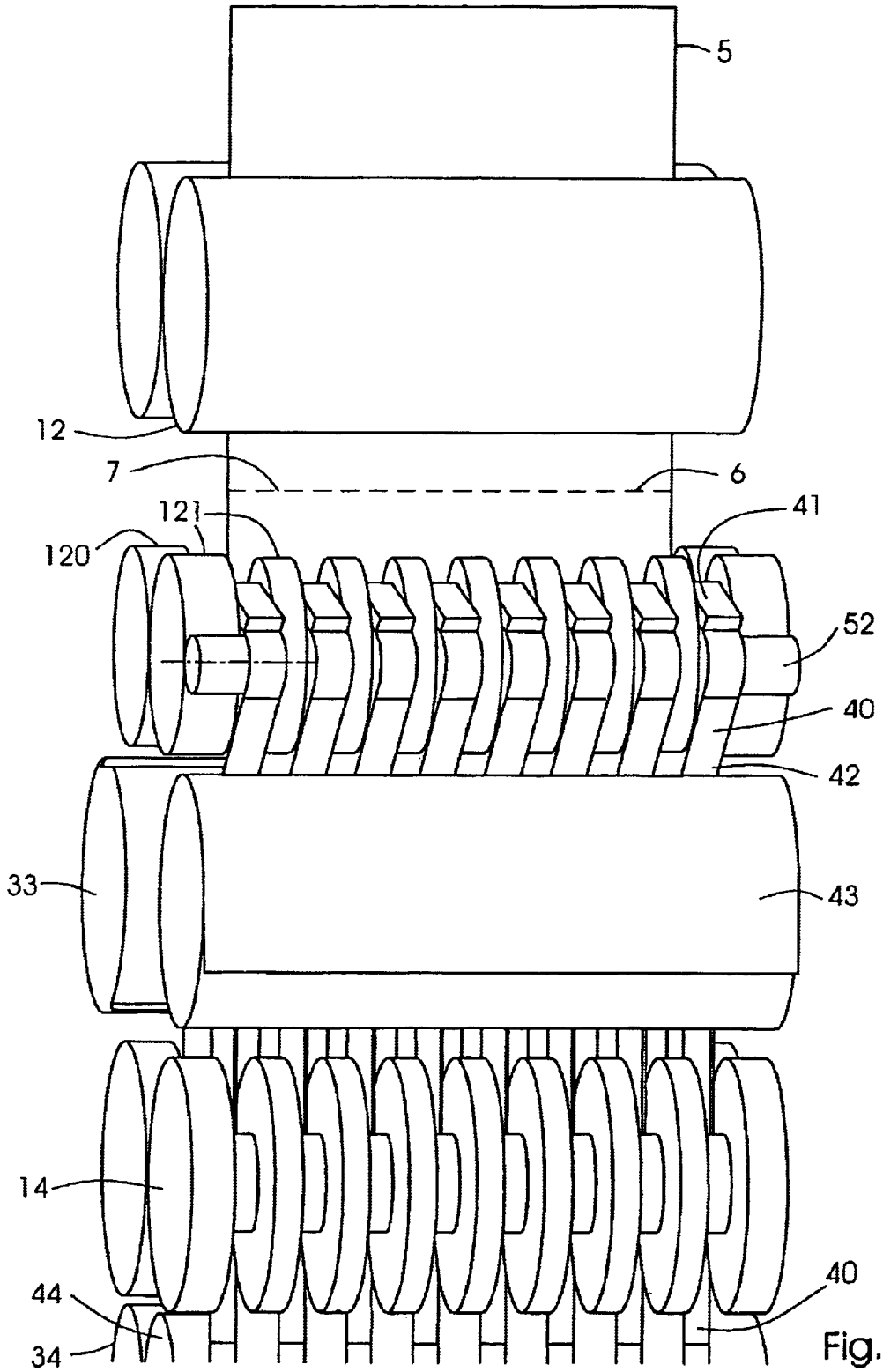
FIG. 2 shows a front perspective view of the cutting unit of the FIG. 1 device.

As shown in FIGS. 1 and 2, a web 5, of, for example, printed paper, enters a first cutting device 12 of cutting unit 10. First cutting device 12 provides perforations 6 in web 5, preferably using a plurality of cutting blades operating against a support surface. A pre-signature with an edge at the perforations thus may be defined. However, web 5 still maintains tension due to connections 7 between perforations 6. Web 5 then enters a pair of rotating disk rollers 20 and 21, each having a plurality of spaced apart side-by-by side disks 120 and 121, respectively, connected by a rotatable axle. Disks 120, 121 form side-by-side spaced apart nips which grip web 5, so that connections 7 pass through the nips. Perforation 6 pass to the side and between the nips.

To provide support as web 5 is cut into signatures, a first set of belts 30 and a second set of belts 40 are provided. First set of belts 30 pass between the spaces formed by spaced disks 120 and second set of belts 40 pass through the spaces formed by spaced disks 121. Belts 40 pass by a support roller 52 and around the axle of disk roller 21. Belts 30 pass by the axle of disk roller 20. Belts 30 and 40 thus align with perforations 6 on web 5, since disks 120,121 align with connections 7.

Belts 30 and 40 are lobed on their outer section, so that raised sections 31 and non-raised sections 32 are formed on the outside of belts 30. Raised sections 41 and non-raised sections 42 are formed on the outside of belts 40. When first set of belts 30 interacts with second set of belts 40, raised sections 31 mesh with non-raised sections 42, and non-raised sections 32 mesh with raised sections 41. The raised sections may be comprised of a plurality of stiff elements arranged next to each other, or of a flexible material, such as rubber. The belt preferably is made of a flexible material such as rubber.

First set of belts 30 and second set of belts 40 are aided in being brought together by guide rollers 33 and 43, respectively. These guide rollers 33, 43 preferably each have a raised surface to interact with the non-raised section 32 and 42 respectively. Belts 30 and 40 also have additional support rollers 34, 35 and 44,45, respectively.

The inside of belts 30, 40 and the outside of the support rollers and the axles of disk rollers 20, 21 preferably all are toothed, so that the belts function as timing belts. This toothed arrangement advantageously maintains the timing between the raised and non-raised sections on the outside of the belts. The teeth may be made from a polymeric material, such as rubber, or from metal.

After web 5 passes disk rollers 20, 21, web 5 is then cut at connections 7 by a second cutting device 14. Second cutting device 14 may include a plurality of cutting disks spaced apart from one another. Preferably, each cutting disk has a blade which interacts with a support disk to provide a clean cut of the web to form a signature. Belt 40 passes between the cutting disks, and belt 30 between the support disks.

Figure 3:
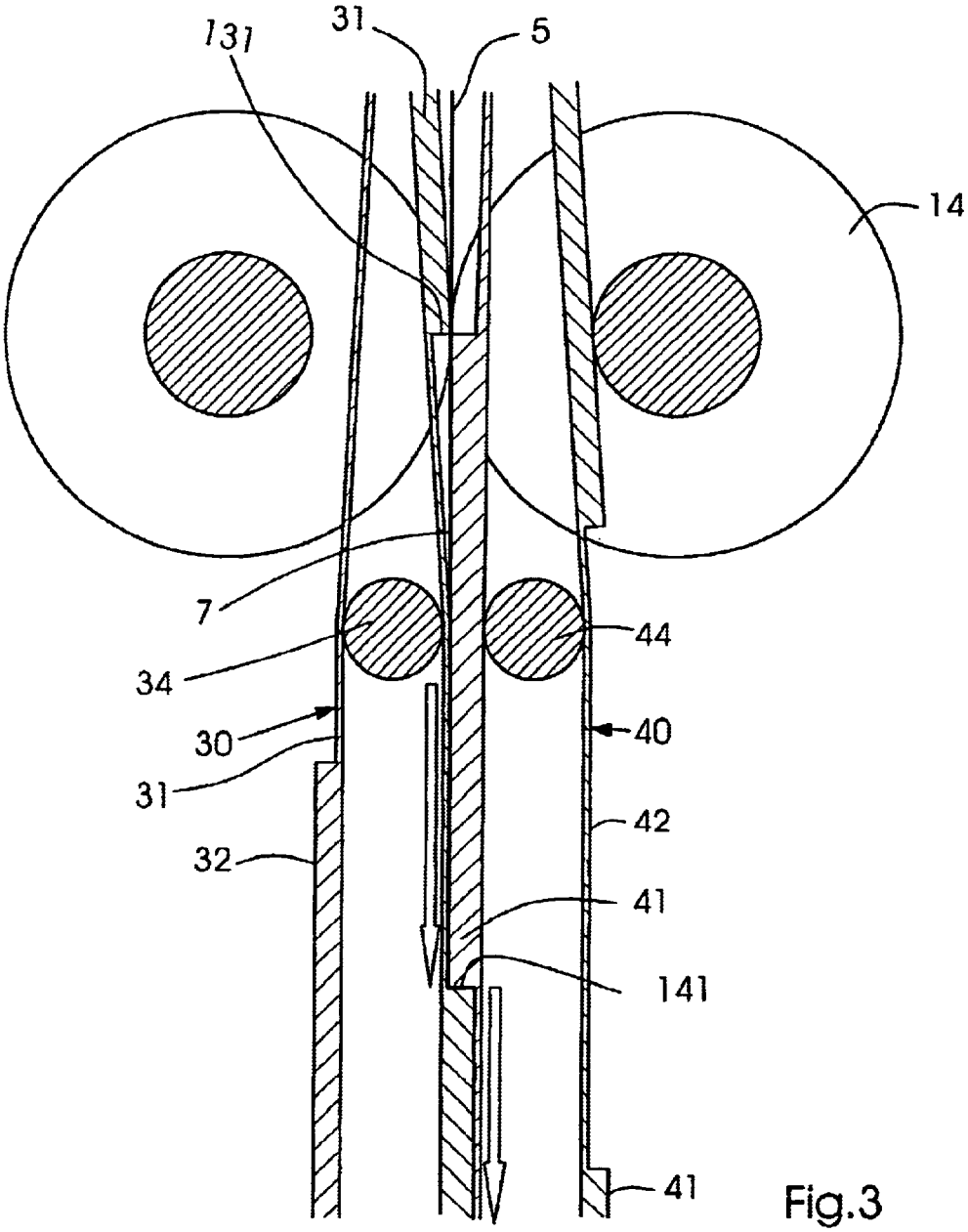
FIG. 3 shows a side view of the second cutting device of FIG. 1.

As shown in FIG. 3, a resultant signature 7 thus is gripped by the belts 30 and 40. The lead edge of the signature 7 matches an edge 131 of raised section 31. The lead edge of the next signature will then match with an edge 141 of raised section 41.

As shown in FIG. 1, the belts 30, 40 come together at the rollers 34, 44. Thus signature 7 is offset to the left as shown in FIG. 3, and the next signature will be offset to the right.

Figure 4:
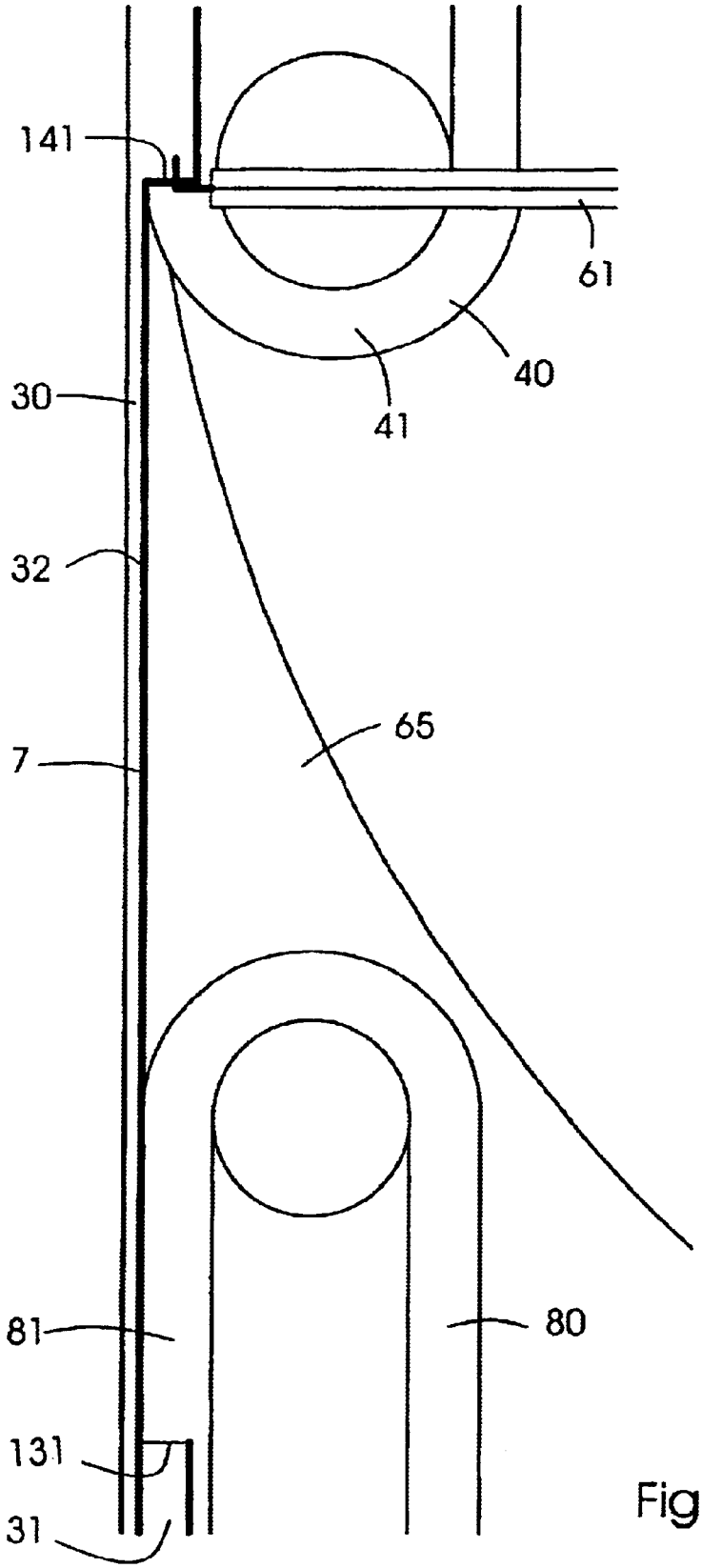
FIG. 4 shows a side view of the region when the signatures either pass to the first delivery device or pass by toward a second delivery device.

As shown in FIGS. 1 and 3, the alternating offset signatures are sent either to a first delivery device 60 or a second delivery device 70. First delivery device 60 has a plurality of grippers 61 and a signature support 65. As shown in FIG. 4, the lead edge of signatures offset to the right are gripped by at least one gripper 61 which passes between spaces between side-by-side belts 40. Preferably, a plurality of side-by-side grippers are provided for each signature. As the lead edge of the signature is gripped, the signature may be, for example, decelerated in a rotational movement by the gripper, the signature being supported by signature support 65, which preferably is a plurality of side-by-side structures spaced apart from one another. The stream of signatures passing through delivery device 60 may then be transferred for further processing or stacking.

The signatures which are not offset to the right by belts 30, 40, but rather to the left, by-pass first delivery device 60. As shown in FIG. 4, this second stream of signatures is at first supported by the back side of signature support 65 and by first set of belts 30. A third set of belts 80 with raised outer portions 81 can pass between the spaces in signature support 65, and hold the signatures of the second stream between raised outer portions 81 and non-raised portions 32 of first belt 30.

As shown in FIG. 1, this second stream of signatures can be accepted by the second delivery device 70 and supported by second signature support 75 in a similar manner to that of first delivery device 60.

Figure 5:
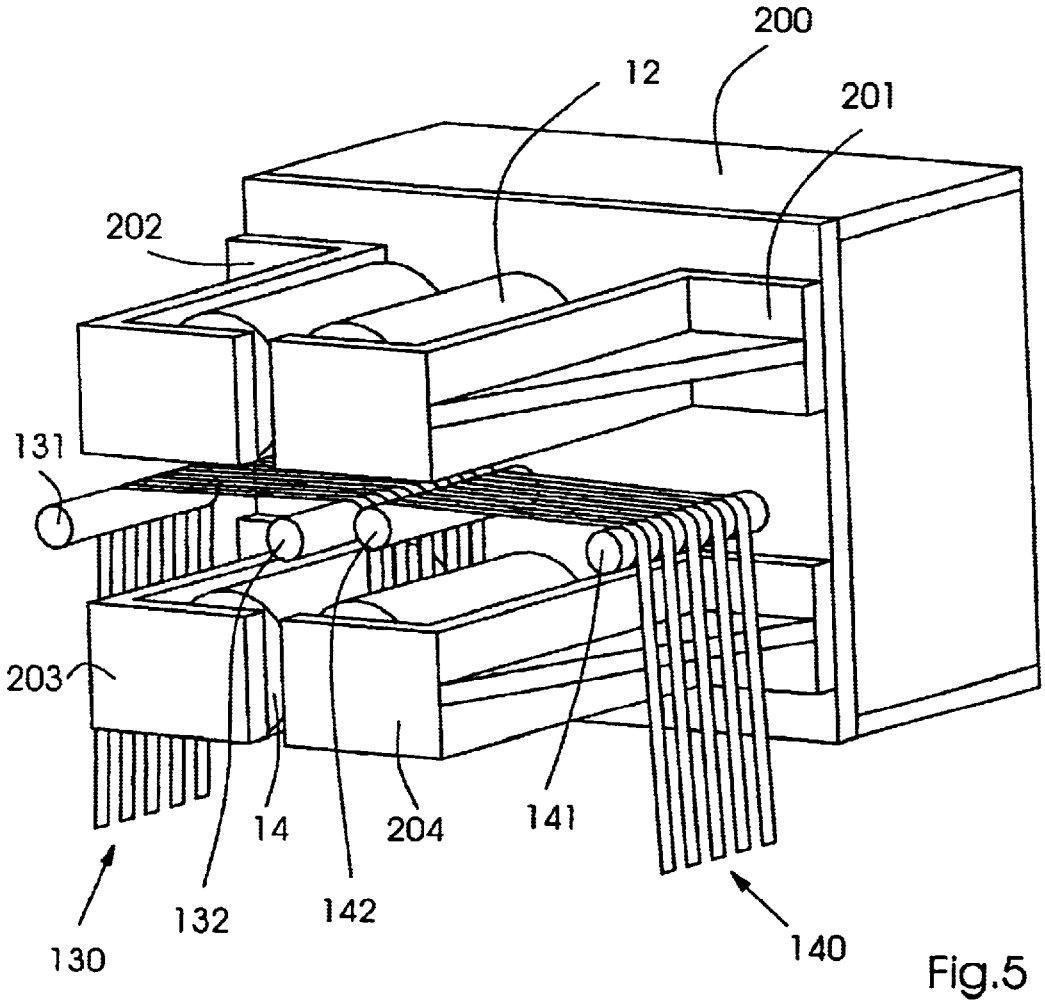
FIG. 5 shows an alternate embodiment of a cutting and diverter unit.

FIG. 5 shows an alternate embodiment of present device in which the belts may be removed for easier replacement. First cutting device 12 is held in a frame 200 by supports 201 and 202. A first set of belts 130 is supported at a top section by a first roller 131 and a second roller 132, which may be cantilevered to the frame 200. A second set of belts 140 is supported at a top section by rollers 141 and 142 which may be cantilevered to frame 200. Alternatively, the rollers 131, 132, 141 and 142 each may have an extra side support which still permits axial removal of the belts 130 and 140. Second cutting device 14 may be supported by supports 203 and 204, which have a gap between them for permitting removal of belts 130 and 140. The cylinders of the second cutting device and the rollers may be equipped with throw-off devices for easier removal of the belt. As an alternative to a throw-off device for the cutting device, a portion of the circumference of the cutting cylinder may have a smaller diameter than the cutting portion, or the difference in thicknesses between the raised and the unraised belt portions could be exploited to aid removal of the belts without cylinder throw off.

The delivery devices preferably are gripper deceleration devices. Such devices are disclosed for example in U.S. Patent Nos. 5,560,599 and 5,794,929, which are hereby incorporated by reference herein. The above-mentioned U.S. Patent Nos. 5,615,878 and 5,607,146 also are incorporated by reference herein.

As defined herein, the term "belt" includes any device for providing a regularly repeating outer surface to the signatures. The terms "first", "second" and "third" are used only to aid clarity and are interchangeable.

What is claimed is:

1. A diverter comprising:

a first cutting device partially cutting a web transversely to a web travel direction in a plurality of locations, the web remaining connected between the plurality of locations;

a second cutting device downstream of the first cutting device fully cutting the web transversely to the web travel direction between the plurality of locations so as to form a plurality of signatures; and a plurality of side-by-side first belts and at least one second belt for holding the plurality of signatures, the first belts having at least one first raised outer section and passing through at least part of the second cutting device, the second belt having at least one second raised outer section, the first and second raised outer sections interacting to offset the plurality of signatures so as to define an alternating first stream and second stream of the plurality of signatures;

wherein the second cutting device includes a plurality of side-by-side spaced-apart cutting disks, the first belts passing between the cutting disks.

2. The diverter as recited in claim 1 further comprising a first delivery device for accepting the first stream and a second delivery device for accepting the second stream, the first delivery device being located above the second delivery device.

3. The diverter as recited in claim 1 wherein the at least one first belt is a timing belt.

4. The diverter as recited in claim 1 further comprising a first delivery device for accepting the first stream, the first delivery device including a signature support.

5. The diverter as recited in claim 4 further comprising at least one third belt for accepting the second stream, the at least third belt passing at least partially through the signature support.

6. The diverter as recited in claim 1 further comprising a disk roller located between the first and second cutting devices.

7. The diverter as recited in claim 6 wherein the at least one first belt passes around an axle of the disk roller.

8. A diverter comprising:

a first cutting device partially cutting a web transversely;

a second cutting device downstream of the first cutting device fully cutting the web so as to form a plurality of signatures;

at least one first belt and at least one second belt for holding the plurality of signatures, the first belt having at least one first raised outer section and passing through at least part of the second cutting device, the second belt having at least one second raised outer section, the first and second raised outer sections interacting to offset the plurality of signatures so as to define an alternating first stream and second stream of the plurality of signatures; and a disk roller located between the first and second cutting devices having a plurality of side-by-side disks on an axle, wherein the at least one first belt passes around the axle of the disk roller between two of the disks.

9. The diverter as recited in claim 8 further comprising a first delivery device for accepting the first stream and a second delivery device for accepting the second stream, the first delivery device being located above the second delivery device.

10. The diverter as recited in claim 8 further comprising a first delivery device for accepting the first stream, the first delivery device including a signature support.

11. The diverter as recited in claim 8 wherein the axle is toothed.

12. The diverter as recited in claim 8 the second cutting device includes a plurality of side-by-side spaced-apart cutting disks, the at least one first belt passing between the cutting disks.

* * * * *